US005323558A

United States Patent [19]

Baumler

[11] Patent Number: 5,323,558

[45] Date of Patent: Jun. 28, 1994

[54] CHRISTMAS TREE SKIRT AND CONTAINER AND FLOOR PROTECTOR

[76] Inventor: Robert W. Baumler, 12217 Tanfield Dr., Whittier, Calif. 90604

[21] Appl. No.: 940,500

[22] Filed: Sep. 4, 1992

Related U.S. Application Data

[63] Continuation-in-part of Ser. No. 825,987, Jan. 27, 1992, which is a continuation of Ser. No. 445,353, Dec. 4, 1989, abandoned, Ser. No. 445,356, Dec. 27, 1989, abandoned, and Ser. No. 721,172, Jun. 26, 1991, abandoned.

[51] Int. Cl.[5] ..... A47G 7/02

[52] U.S. Cl. ..... 47/40.5; 47/84; 206/423; 383/109

[58] Field of Search ..... 47/40.5, 84; 206/423; 383/109

[56] References Cited

U.S. PATENT DOCUMENTS

| | | | |
|---|---|---|---|
| 1,681,922 | 8/1928 | Boch | 383/109 |
| 1,811,574 | 6/1931 | Barrett | 206/423 |
| 2,911,025 | 11/1959 | Paros | 206/423 |
| 2,934,204 | 4/1960 | Pardee | 206/423 |
| 3,061,170 | 10/1962 | Baker | 383/109 |
| 3,249,286 | 5/1966 | Palmer | 383/109 |
| 3,729,039 | 4/1973 | Walsh | 206/423 |
| 3,872,906 | 3/1975 | Bolanz | 248/38 |
| 3,924,669 | 12/1975 | Price | 206/423 |
| 4,297,811 | 11/1981 | Weder | 47/72 |
| 4,337,812 | 7/1982 | Trinkner | 383/109 |

FOREIGN PATENT DOCUMENTS

| | | | |
|---|---|---|---|
| 1293426 | 4/1969 | Fed. Rep. of Germany | 206/423 |

*Primary Examiner*—Henry E. Raduazo
*Attorney, Agent, or Firm*—Grant L. Hubbard

[57] ABSTRACT

A Christmas tree or tree container and protective underlay comprising a bottom which lays in a flat circular sheet forming the top of a first open bottomed container and the bottom of a second open topped container, the walls and circular sheet being so constructed, secured and configured as to define cylindrical containers closed at one end with the disk-shaped circular sheet and open at the other end and being substantially moisture and vapor tight, the first container walls being constructed and configured to be folded accordion-like under the circular sheet during display of the Christmas tree and to be lifted to enclose the Christmas tree for disposal thereof is disclosed.

6 Claims, 3 Drawing Sheets

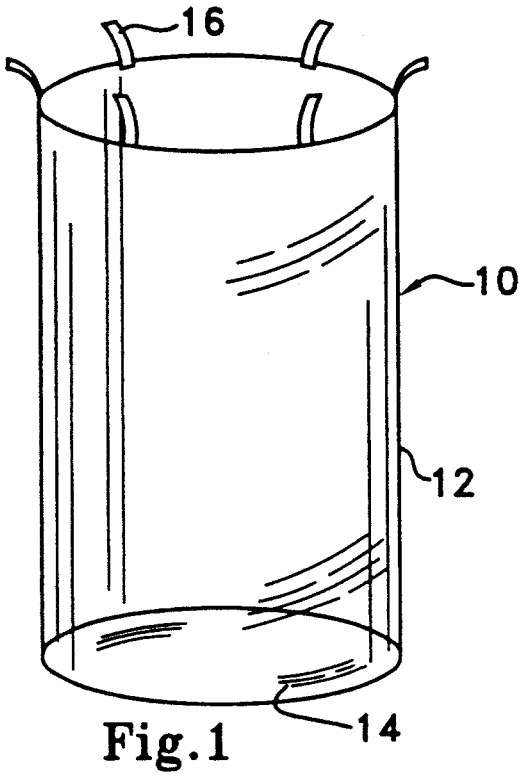
Fig.1
Fig.2
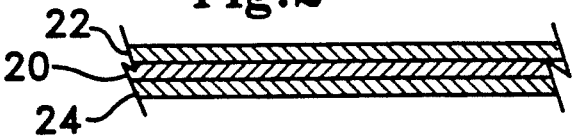
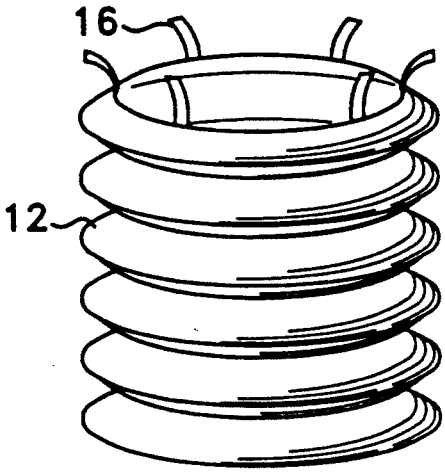
Fig.3
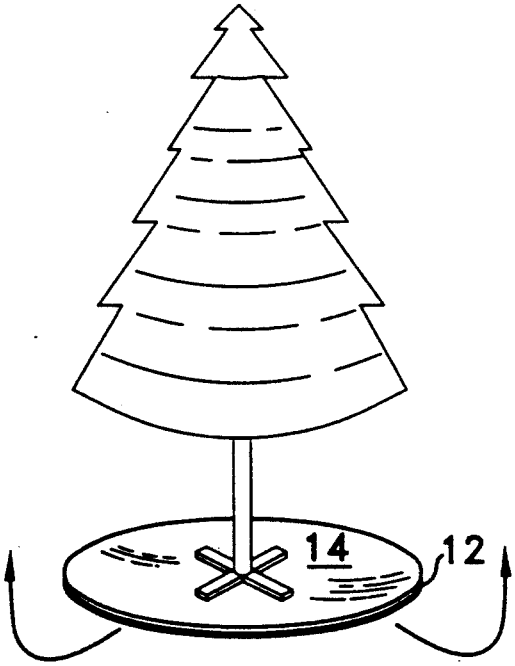
Fig.4
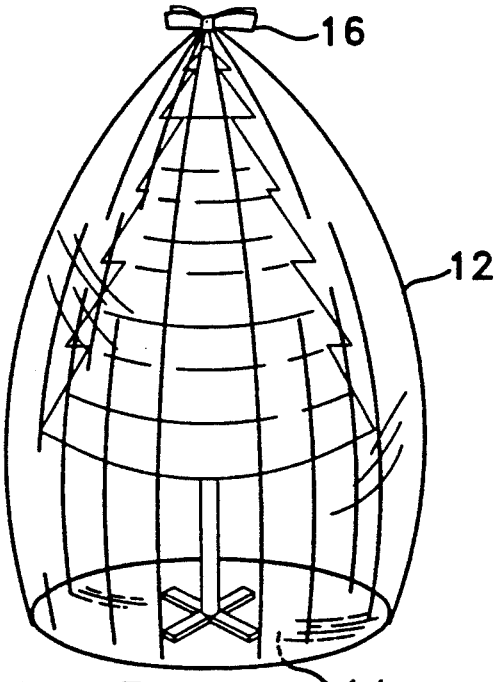
Fig.5

Fig.9
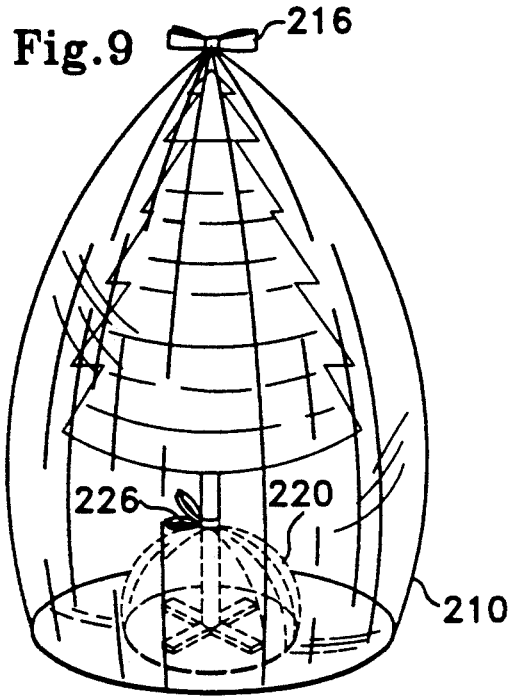
Fig.11
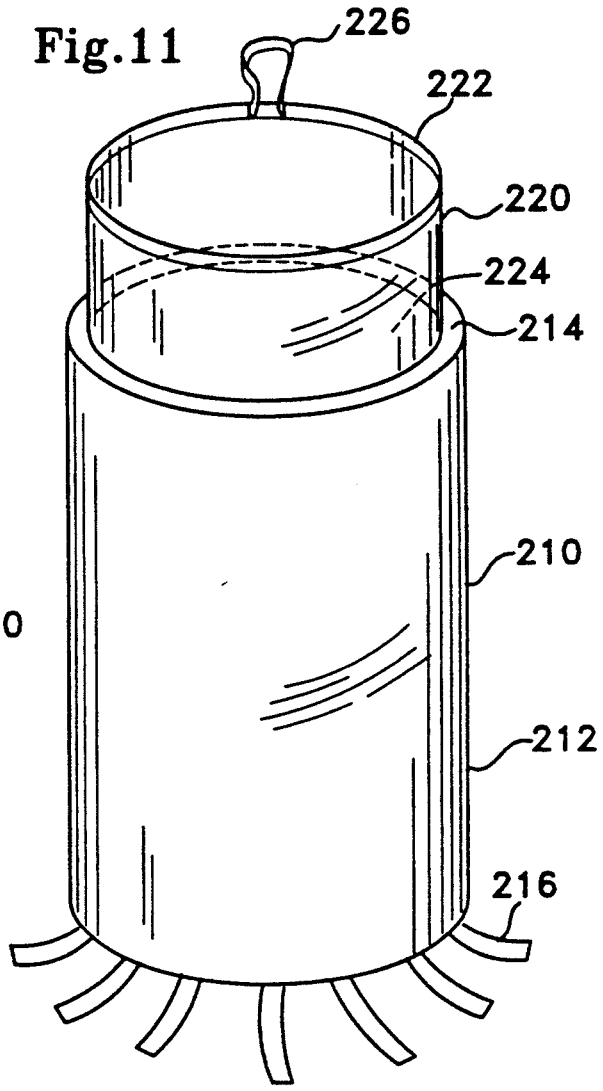
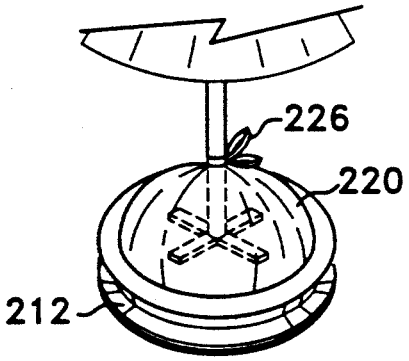
Fig.10
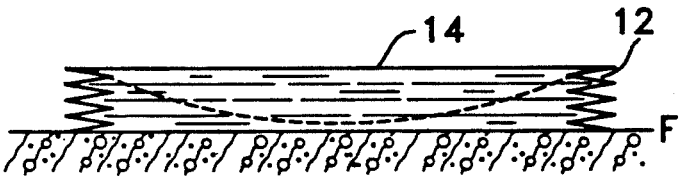
Fig.12

CHRISTMAS TREE SKIRT AND CONTAINER AND FLOOR PROTECTOR

CROSS-REFERENCE TO RELATED APPLICATIONS

This is a continuation-in-part of co-pending U.S. application Ser. No. 07/825,987, filed Jan. 27, 1992, and now abandoned, which is a continuation of U.S. patent application Ser. Nos. 07/445,353, Dec. 4, 1989, 07/445,356, Jan. 27, 1989 and 721,172, Jul. 26, 1991, which priority is claimed, now all abandoned.

BACKGROUND OF THE INVENTION

This invention relates to a container specifically designed as a base for and as a container for Christmas trees to a container specifically designed an underlay for a Christmas tree and wrap-container for the stand, bucket, or other support for Christmas trees.

The Christmas tree, in much of the Christian world, particularly in Northern Europe and in the United States, has become a symbol of the Christmas holidays.

Among the problems associated with Christmas trees are moisture or sap damage to the floor or carpet and the inconvenience, the dropping of dry leaves or needles on the floor or carpet and the difficulty in removing the Christmas tree and preventing the spread of dry needles, dust, and remnants of decorations far and wide when the used Christmas tree is disposed of.

Another aspect of the usage of Christmas trees, providing an ornamental or decorative base for the Christmas tree, is also addressed and provision is made for a utilitarian as well as decorative base for the Christmas tree.

It is well known and common in the use of Christmas trees to provide some kind of a decorative or ornamental base. Sometimes the base is a layer of cotton, representing snow, or a highly colored paper or film which is spread on the carpet or floor underneath the Christmas tree. These devices provide an ornamental setting for the Christmas tree and, in some instances, provide some limited protection for the floor or carpet under the Christmas tree. It is also known to provide a plastic sheet under the Christmas tree to protect the carpet or floor from the moisture which seeps out of the Christmas tree, from the dropping of sap, needles and the like, and if provided, the protection of the floor from watering or moisturizing the Christmas tree. No single device, however, provides a decorative underlay for the Christmas tree, protects the floor or carpet from the Christmas tree, and collects and prevents the spread of falling or dried or loose needles or leaves. It is to a solution of these three problems that the present invention is directed.

SUMMARY OF THE INVENTION

This invention relates to a special metalized plastic container which forms a decorative underlay for the Christmas tree enwraps and encloses the Christmas Tree when it is disposed of. The invention prevents the scattering and spread of sap, needles, dust, ornament fragments, and the like upon removal of the Christmas tree.

A Christmas tree container and protective underlay is disclosed and claimed herein. The container and underlay comprises a generally circular bottom constructed and configured to lay in a flat circular configuration on a floor under a Christmas tree and a generally cylindrical wall construction. The wall construction has first and second ends and is constructed and configured to enclose such Christmas tree, in one use-position thereof for containing the tree in preparation for or after displaying the Christmas tree, and to lie in a generally annular accordion-like folded configuration under the periphery of the generally circular bottom for displaying the Christmas tree. The wall is bonded along the first end to the periphery of the bottom for forming a cylindrical container which is substantially liquid tight in the wall and bottom areas. The top of the container is defined by the open second end of the cylindrical wall. The bottom and wall are, preferably formed, in whole or in part, of polymeric film which is substantially liquid proof. The bottom and wall are formed of a three-layer film structure comprising a central film of strong, tough polymer, a decorative layer on one side of the central film and a heat sealable thermoplastic film on the other side of the central film. Means may be secured to the second end for securing the second end of the cylindrical wall together for closing the container.

An alternative embodiment of the Christmas tree comprises a generally circular bottom constructed and configured to lay in a flat circular configuration on a floor under a Christmas tree and a generally cylindrical first wall construction. The first wall construction has first and second ends and is constructed and configured to enclose such Christmas tree, in one use-position thereof for containing the Christmas tree in preparation for or after displaying the Christmas tree, and to lie in a generally annular accordion-like folded configuration under the periphery of the generally circular bottom for displaying the Christmas tree. The first wall is bonded along the first end to the periphery of the bottom for forming a cylindrical container which is substantially liquid tight in the first wall and bottom areas. The top of the container is defined by the open second end of the cylindrical first wall. Extending in the opposite direction from the first wall structure is a second wall structure that forms a generally cylindrical container for the base of the Christmas tree and has means, such as a tie ribbon, for enclosing the base of a Christmas tree, and tying the cylindrical wall to the trunk of the Christmas tree. The bottom and wall are, preferably formed, in whole or in part, of polymeric film which is substantially liquid proof. The second wall may be formed or secured at the periphery of a separate bottom, and the separate bottom secured to the bottom previously described by adhesive, fastener, or heat seal, or in any other convenient manner. The bottom and wall are formed of a three-layer film structure comprising a central film of strong, tough polymer, a decorative layer on one side of the central film and a heat sealable thermoplastic film on the other side of the central film. Means may be secured to the second end for securing the second end of the cylindrical wall together for closing the container.

The invention is also embodied in a method of displaying the Christmas tree, which may be cut or living. The method involves the steps of positioning the Christmas tree for display on the generally circular bottom of a display and container, said bottom constructed and configured to lay in a flat circular configuration under the Christmas tree, the Christmas tree display and container comprising a generally cylindrical wall construction having first and second ends, said wall being constructed and configured to enclose such Christmas tree and to lie in a generally accordion-like folded configuration under the periphery of the generally circular bottom, said wall being bonded along the first end to the periphery of the bottom for forming a cylindrical container which is substantially liquid tight in the wall and bottom areas, the top being defined by the open second end of the cylindrical wall, the bottom and wall being formed of flexible polymeric film which is substantially liquid proof, the wall being arranged in a generally annular accordion-like folded configuration under the periphery of the generally circular bottom, withdrawing the wall from under the bottom and pulling the wall up over the Christmas tree to substantially enclose the Christmas tree; and securing the top of the wall to maintain the wall around and substantially containing the Christmas tree. The top end may be secure to the Christmas tree or the top end of the wall together above the top of the Christmas tree.

This invention relates to a special metalized plastic container which, while the Christmas tree or Christmas tree is on display, forms a decorative underlay for the Christmas tree and cover which enwraps and encloses the stand or support for the Christmas tree or other Christmas tree.

A Christmas tree stand or material or layer cover and protective underlay is disclosed and claimed herein. The container and underlay comprises a generally circular bottom constructed and configured to lay in a flat circular configuration on a floor under a Christmas tree stand and a generally cylindrical wall construction. The wall construction has first and second ends and is constructed and configured to enclose such Christmas tree stand or support for displaying the Christmas tree.

The wall is bonded along the first end to the periphery of the bottom for forming a cylindrical container which is substantially liquid tight in the wall and bottom areas. The top of the container is defined by the open second end of the cylindrical wall. The bottom and wall are, preferably formed, in whole or in part, of polymeric film which is substantially liquid proof. The bottom and wall are formed of a three-layer film structure comprising a central film of strong, tough polymer, a decorative layer on one side of the central film and a heat sealable thermoplastic film on the other side of the central film. Means may be secured to the second end for securing the second end of the cylindrical wall together for closing the container.

The invention is also embodied in a method of displaying and containing a Christmas tree which may be cut or living. The method involves the steps of positioning the Christmas tree for display on the generally circular bottom of a Christmas tree display and container, said bottom constructed and configured to lay in a flat circular configuration under the Christmas tree, the Christmas tree display and container comprising a generally cylindrical wall construction having first and second ends, said wall being constructed and configured to enclose base, support, container or stand for the Christmas tree or other Christmas tree, said wall being bonded along the first end to the periphery of the bottom for forming a cylindrical container which is substantially liquid tight in the wall and bottom areas, the top being defined by the open second end of the cylindrical wall, the bottom and wall being formed of flexible polymeric film which is substantially liquid proof, and securing the top of the wall to maintain the wall around and substantially containing the Christmas tree or Christmas tree base or support.

BRIEF DESCRIPTION OF THE DRAWINGS

FIG. 1 depicts a side view of the container of a first embodiment of this invention showing the structural features and relationships thereof, the container being fully extended.

FIG. 2 depicts a cross-section of a portion of an exemplary film construction suitable for use in a preferred embodiment of this invention.

FIG. 3 depict a side view of the container of this invention partially collapsed.

FIG. 4 depicts the container of this invention serving its function as an underlay for a Christmas tree to protect the carpet or floor, arrows indicating the mode of opening of the container to enclose the tree when the tree is to be disposed of.

FIG. 5 is a side view of the container with an enclosed Christmas tree.

FIG. 9 depicts another alternative embodiment of the invention in use, this embodiment characterized in being a generally unitary structure forming a first container for the entire Christmas tree and a second container for the base of or support for the Christmas tree.

FIG. 10 depicts the embodiment of FIG. 9 with the first container for the entire Christmas tree mostly folded in accordion form lying on a floor or the like and the second container enclosing the support for the Christmas tree.

FIG. 11 depicts the structural details of a preferred embodiment of the container-protector of FIG. 10.

FIG. 12 depicts the embodiment of FIGS. 3 and 4 showing the configuration the protective container assumes when placed on a floor with the accordion folded walls under the peripheral edge of the circular bottom structure.

DESCRIPTION OF THE PREFERRED EMBODIMENT

Figure 6:
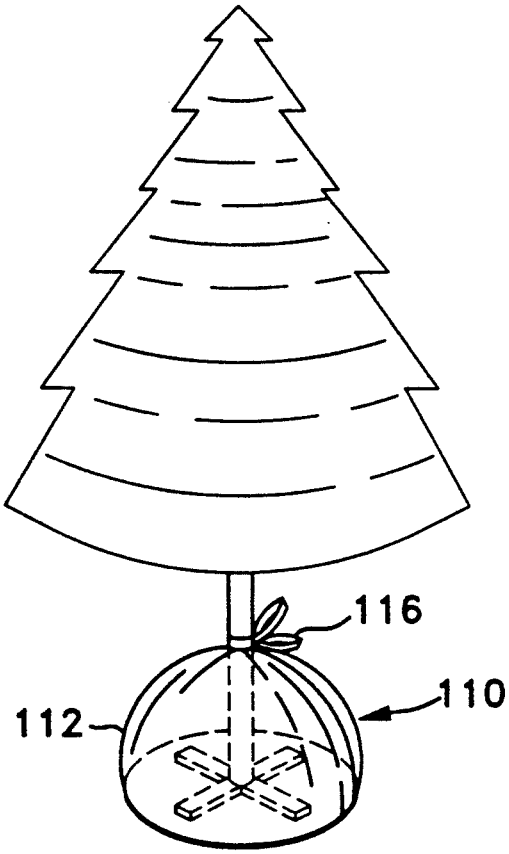
FIG. 6 depicts a side view of a second embodiment of the container of this invention showing the structural features and relationships thereof in use.

In the following discussion, the preferred and exemplary embodiment of the invention will be described, without limiting the scope of the invention, however, the scope being defined by the claims which are appended hereto.

Referring first to FIG. 1, the container of this invention is shown in a side view in its fully extended and opened position. The container 10 comprises a cylindrical wall 12 bonded or secured or formed integrally with peripheral edge portion of the disk-shaped, flat circular bottom 14, the walls 12 and bottom 14 being so constructed and configured as to define a cylindrical container closed at the bottom with the disk-shaped circular bottom and open at the top. Tbe container, when unfolded and expanded defining a closed-bottom right-cylinder which, except for the top, is substantially moisture and vapor tight.

In the preferred embodiment, a plurality of tabs 16, six of which are shown in the exemplary embodiment, are provided around the top. These tabs may be sewn or bonded to the upper edge of the cylinder in any convenient manner.

The container may be clear, i.e. formed of a clear polymeric film, as suggested by FIG. 1, or it may be and preferably is formed of a metalized film such as shown in cross-section in FIG. 2. The preferred form of the film comprises a polymeric film 20 of a very strong and tough polymer such as MYLAR® (Dupont), polyethyleneterphthalate or a polycarbonate film. One side of the tough polymeric film 20 is, in a preferred embodiment, metalized with a layer of aluminum, typically, which may be anodized to provide any of several colors, any metalizing material and technique may be used. The thickness and nature of metalization will render the film fully opaque or partially opaque and partially transparent, depending on the amount and the method of application of the metalizing material.

FIG. 3 depicts the container partially folded. In the preferred embodiment, the walls 12 of the container are folded in an accordion-like manner to form a flat circular configuration, such as shown in FIG. 4.

Referring now specifically to FIGS. 4 and 12, it will be seen that the underside of the bottom film 14 is facing upwardly with the folded walls 12 in layers beneath the bottom. In this configuration, the bottom layer 14 serves as a floor or carpet protector, preventing moisture, sap, needles and the like from falling on the floor.

Very importantly, the peripheral edge of the bottom film is lifted from the floor by the accordion folded walls 12 thus making the bottom film conform to a generally saucer-like configuration. The edges are, typically, from ¼ to 1 inch, or more, above the floor. As best shown in FIG. 12, the bottom film defines a container capable of containing liquids thereby preventing spillage of moisturizing liquids onto the floor. Also very importantly, needles, ornaments, etc. tend to roll inwardly thereby preventing the scattering of such debris on the floor. While the lifted peripheral edge of the bottom is not a substantial barrier, it is high enough to discourage very small children from crawling closer to the tree. In effect, it marks the limit of approachment to the Christmas tree. This protects the tree from the child, of course, but, more importantly, protects the child from broken ornaments, etc., which tend to roll inwardly toward the center of the cover.

When it is desired to move or dispose of the Christmas tree, or other Christmas tree or the like, it is not necessary to remove the Christmas tree from the underlying protective film. As suggested in the arrows shown in FIG. 4, the walls 12 are simply pulled outwardly and upwardly and over the Christmas tree, as shown in FIG. 5, with the top of the cylinder tied together by the ties 16. Obviously, the ties 16 are not necessary but are very convenient as an integral part of the invention.

Returning again for a moment to the film construction, the preferred form of film is generally as depicted in FIG. 2. This three-layer film provides an optimum of visual and practical characteristics. Tbe tough polymeric film 20, such as MYLAR or polycarbonate, or any other suitably tough and strong film, provides the strength necessary for the container of this invention. A single wall of polyethylene is insufficiently strong for use in the present invention since it tends to stretch and tear rather easily. Multiple layers of polyethylene could, however, be used, although less satisfactorily than a film construction in which the strength is derived from MYLAR or polycarbonate. On one side of the film 20 is a layer of metalizing or coloring substance. In the preferred embodiment shown in the drawings, a metalizing film is shown. The film is typically aluminum, as is commonly used in metalizing MYLAR films, although any metalizing material and technique suitable for applying a thin metal film to polymer may be used. Stainless steel, tin, and other materials may be used, for example, as metalizing materials, although aluminum is the most efficient for most purposes.

On the opposite side from the metalizing layer is a layer 24 of a thermal plastic film such as polyethylene or polypropylene. The provision of this layer of thermal plastic film bonded uniformly and integrally with the stronger MYLAR or polycarbonate film permits the heat sealing of the film to form the container. The seals are generally required around the bottom 14 of the container and, unless the film is formed as a tube, along a side of the container. Tbe layer 24 also permits the integral bonding of tab 16 to the container construction.

Referring now to FIG. 5, it will be understood that the entire combination of FIG. 5 may be sold as an article of commerce. For example, in order to protect the Christmas tree from wind and abrasion during handling, the entire Christmas tree may be enclosed in the container, and the enclosed Christmas tree, container and all, sold as a unit. Once in place, the walls 12 may be folded down underneath the bottom 14 to achieve the configuration shown in FIGS. 4 and 11. Thus, the invention is embodied, in one configuration, as a Christmas tree enclosed in the container as described.

The invention is also embodied in a method of enclosing a Christmas tree which uses the construction as described in the manner previously described.

Figure 7:
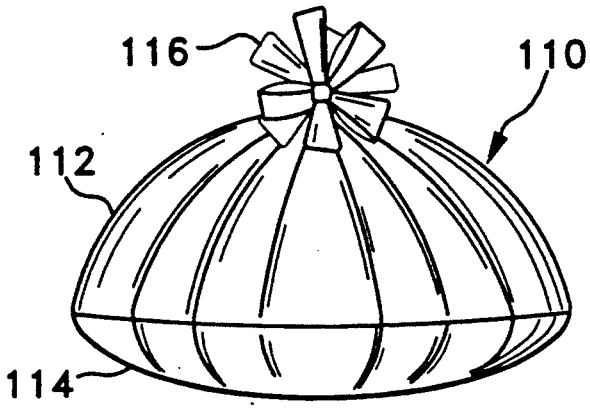
FIG. 7 is a side view of the container, after use, enclosing needles, broken ornaments, sweepings, etc. remaining from the use of the Christmas tree.
Figure 8:
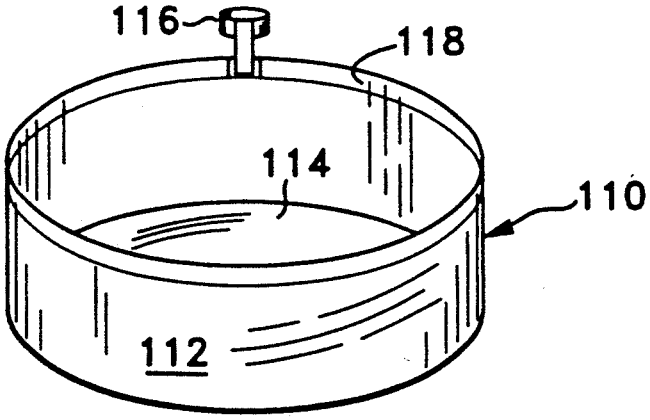
FIG. 8 depicts the container of this invention showing the structure thereof in some detail.

Referring now to FIG. 6, the first alternative form of the container of this invention is shown in a side view in use about the base of a Christmas tree. FIG. 7 shows this form of the invention in use to collect needles, etc., after disposing of the Christmas tree. The structure of this embodiment is shown in FIG. 8. The container 110 comprises a cylindrical wall 112 bonded or secured or formed integrally with peripheral edge portion of the disk-shaped, flat circular bottom 114, the walls 112 and bottom 114 being so constructed and configured as to define a cylindrical container closed at the bottom with the disk-shaped circular bottom and open at the top. The container, when unfolded and expanded defining a closed-bottom right-cylinder which, except for the top, is substantially moisture and vapor tight. It has been discovered that there is a very important relationship between the diameter of the bottom and the height of the walls of the cylinder. It is critical, for optimum functionality, that the height of the walls be within 25% of the radius of the base or bottom, and the most useable structure results when the walls are within 15% of the radius. Stated differently, the ratio of H, the wall height, to R, the bottom radius, is $H_{WALL}=R_{BOTTOM}\pm 25\%$ and, preferably, $H_{WALL}=R_{BOTTOM}\pm 15\%$.

In the preferred embodiment, a draw-string or drawband 116 received in a circular passage formed by the upper edge structure 118 of the cylindrical wall 112.

The container may be clear, i.e. formed of a clear polymeric film, as suggested by FIG. 6, or it may be and preferably is formed of a metalized film such as shown in cross-section in FIG. 2. The preferred form of the film comprises a polymeric film of a very strong and tough polymer such as MYLAR® (Dupont), polyethyleneterphthalate or a polycarbonate film. One side of the tough polymeric film is, in a preferred embodiment, metalized with a layer of aluminum, typically, which may be anodized to provide any of several colors, any metalizing material and technique may be used. The thickness and nature of metalization will render the film fully opaque or partially opaque and partially transparent, depending on the amount and the method of application of the metalizing material. Single of multiple layers of polyethylene or other polymer film, paper, fabric, etc. may, however, be used.

Returning again for a moment to the film construction, a three-layer film provides an optimum of visual and practical characteristics. A tough polymeric film, such as MYLAR or polycarbonate, or any other suitably tough and strong film, provides the strength necessary for the container of this invention. A single wall of polyethylene may be insufficiently strong for use with very large Christmas trees since it tends to stretch and tear rather easily. Multiple layers of polyethylene could, however, be used, although less satisfactorily than a film construction in which the strength is derived from MYLAR or polycarbonate. On one side of the film is a layer of metalizing or coloring substance. The film is typically aluminumized, as is commonly used in metalizing MYLAR films, although any metalizing material and technique suitable for applying a thin metal film to polymer may be used. Stainless steel, tin, and other materials may be used, for example, as metalizing materials, although aluminum is the most efficient for most purposes.

On the opposite side from the metalizing layer is a layer of a thermal plastic film such as polyethylene or polypropylene. The provision of this layer of thermal plastic film bonded uniformly and integrally with the stronger MYLAR or polycarbonate film permits the heat sealing of the film to form the container. The seals are generally required around the bottom 114 of the container and, unless the film is formed as a tube, along a side of the container. The sealing layer also permits the integral bonding of the layers of the container construction.

Referring now to FIGS. 9–11 generally, with particular attention to FIG. 11, another embodiment the container of this invention is shown in a side view in its fully extended and opened position. The first container 210 comprises a first cylindrical wall 212 bonded or secured or formed integrally with peripheral edge portion of the disk-shaped, flat circular sheet 214 that may form the closed top of the first container and the bottom of the second container described below. Separate circular sheets may be used and sealed, fastened of bonded together, resulting, of course, in a functionally identical structure. The walls 212 and sheet 214 are so constructed and configured as to define a cylindrical container closed at top with the disk-shaped circular top and open at the bottom. The container, when unfolded and expanded defining a closed-bottom right-cylinder which, except for the top, is substantially moisture and vapor tight.

In the preferred embodiment, a plurality of tabs 216, six of which are shown in the exemplary embodiment, are provided around the bottom. These tabs may be sewn or bonded to the bottom edge of the first cylinder in any convenient manner.

The second container 220 is formed integrally with the first container. The second, upwardly open container 220 comprises a cylindrical wall 222 bonded or secured or formed integrally with the disk-shaped, flat circular sheet 214, preferably, but not necessarily inwardly of the periphery. All or a portion 224 of the sheet 214 is common to both the first and second containers, forming the top of the first container and the bottom of the second container. The bottom 224 of the second container may be coextensive with the sheet 214 but generally is smaller. The walls 212 and bottom 214 are so constructed and configured as to define a cylindrical container closed at the bottom with the disk-shaped circular bottom and open at the top. The container, when unfolded and expanded defining a closed-bottom right-cylinder which, except for the top, is substantially moisture and vapor tight.

In the preferred embodiment, a draw-string or draw-band 226 received in a circular passage formed by the upper edge structure in the manner previously described.

The first stage of use of the invention is depicted in FIG. 10. The first container is largely folded accordion-like under the sheet, only a small portion being unfolded, simply for illustrative purposes. In use, all of the walls 212 are accordion folded under the sheet 214.

A second stage of use is depicted in FIG. 9 showing how a Christmas tree is wrapped for disposal or for protecting a Christmas tree during transportation. When it is desired to move or dispose of the Christmas tree, or other Christmas tree or the like, or to ship a Christmas tree, the first container is unfolded upwardly over the entire Christmas tree and the entire now-closed package may be disposed of without soiling any other area or shipped as an article of commerce.

The container may be clear, i.e. formed of a clear polymeric film or it may be and preferably is formed of a metalized film such as described above.

Again, considerable variation is permitted within the scope of the invention without departing from the spirit thereof.

INDUSTRIAL APPLICATION

This invention finds application in nursery enterprises generally and particularly with respect to nurseries and other establishments which trade in Christmas trees and the like.

What is claimed is:

1. A Christmas tree base enclosure and disposal container for protecting a floor during display of the Christmas tree comprising m combination a first container (210) that comprises a first cylindrical wall (212), a disk-shaped, flat circular sheet (214), the wall being secured to peripheral edge portion of the circular sheet, the walls (212) and sheet (214) being so constructed and configured as to define a cylindrical container closed at top with the disk-shaped circular sheet forming the top, and open at the bottom, and a second container (220) comprising a cylindrical wall (222) secured to the disk-shaped, flat circular sheet (214), at least a portion (224) of the sheet (214) forming the top of the first container lying in the plane of the bottom of the second container, the walls and circular sheet being so constructed, secured and configured as to define cylindrical containers closed at one end with the disk-shaped circular sheet and open at the other end and being substantially moisture and vapor tight, the first container walls being constructed and configured to be folded accordion-like under the circular sheet during display of the Christmas tree thereby making the disk-shaped circular sheet conform generally to a saucer-like configuration and to be lifted to enclose the Christmas tree for disposing of the Christmas tree.

2. A Christmas tree base enclosure and disposal container for protecting a floor during display of the Christmas tree comprising m combination a first container (210) that comprises a first cylindrical wall (212), a disk-shaped, flat circular sheet (214), the wall being secured to peripheral edge portion of the circular sheet, the walls (212) and sheet (214) being so constructed and configured as to define a cylindrical container closed at top with the disk-shaped circular sheet forming the top, and open at the bottom, and a second container (220) comprising a cylindrical wall (222) extending oppositely, with respect to the first cylindrical wall, from disk-shaped, flat circular sheet (214), the walls and circular sheet being so constructed, secured and configured as to define cylindrical containers closed at one end and open at the other end, the two ends extending in opposite directions from the circular sheet and, except for the open ends, forming two substantially moisture and vapor tight cylinders, the first container walls being constructed and configured to be folded accordion-like under the circular sheet during display of the Christmas tree and to be lifted to enclose the Christmas tree for shipping or handling the Christmas tree.

3. A completely foldable, Christmas tree stand or base cover and protective underlay comprising:

(a) a generally circular bottom having a radius constructed and configured of a flexible, foldable continuous three-layer film structure comprising a central film of strong, tough polymer, a decorative layer on one side of the central film and a heat sealable thermoplastic film on the other side of the central film to lay in a flat circular configuration on a floor under a Christmas tree stand; and (b) a generally cylindrical wall construction having a height and first and second ends, said wall being constructed and configured of a three-layer film structure comprising a film of strong, tough polymer, a decorative layer on one side of the central film and a heat sealable thermoplastic film on the other side of the central film to enclose such Christmas tree stand;

the wall height being in the ratio to the radius of the bottom $$H_{WALL}=R_{BOTTOM}\pm 25\%;$$

said wall being bonded along the first end to the periphery of the bottom, the film structure forming the wall being bonded so as to extend substantially perpendicular to the film forming the bottom for forming a cylindrical container which is substantially liquid tight in the wall and bottom areas, the top being defined by the open second end of the cylindrical wall, the bottom and wall forming a substantially liquid proof right cylindrical container which is closed at the bottom and open at the top, the top being so constructed and defined as to be foldable inwardly over and around the Christmas tree stand.

4. The Christmas tree base enclosure of claim 3 further comprising another cylindrical wall and a disk-shaped, flat circular sheet, the last said wall being secured to peripheral edge portion of the last said circular sheet, the last said walls and sheet being so constructed and configured as to define a cylindrical container closed at top with the disk-shaped circular sheet forming the top, and open at the bottom, the last said container walls being constructed and configured to be folded accordion-like under the last said circular sheet during display of the Christmas tree thereby making the last said disk-shaped circular sheet conform generally to a saucer-like configuration and to be lifted to enclose the Christmas tree for disposing of the Christmas tree.

5. In combination, a Christmas tree and an underlay and disposal container for the tree, the underlay and disposal container comprising, a disc having a center and a radius constructed and configured of a flexible, foldable continuous three-layer film structure comprising a central film of strong, tough polymer, a decorative layer on one side of the central film and a heat sealable thermoplastic film on the other side of the central film in a flat circular configuration underlying the Christmas tree stand, and a cylindrical wall the top end of which is secured to the peripheral edge of the disc so as to define a cylindrical container closed at top with the disc forming the top, and open at the bottom, the cylindrical wall being folded accordion-like to form a circular structure lying under and lifting the periphery of the disc relative to the center of the disk for forming a saucer-like shape in which the center is lower than the periphery for directing needles and objects that fall from the tree inwardly toward the center of the disk and being so constructed and configured so as to be capable of being lifted around the disk and upwardly around and enclosing the Christmas tree for containing the tree when disposing of the same.

6. A method of forming an underlay for a Christmas tree that can subsequently to used to enclose the Christmas tree comprising:

(a) placing a generally circular disk of flexible waterproof sheeting having a generally cylindrical wall of flexible waterproof material extending in a first direction from the circumferential periphery of said disk, said wall being folded in an accordian-like configuration, on a floor with the cylindrical wall under the periphery of the disk to raise the edges of the disk thereby forming a receptable having a raised general circumferential periphery; and (b) placing the Christmas tree in the thus formed receptable;

the disk and wall being so constructed and arranged as to permit the cylindrical wall to be pulled from under periphery of the disk, unfolded from the accordian-like configuration and raised to enclose the Christmas tree.

* * * * *